US005360085A

United States Patent [19]

Yoo et al.

[11] Patent Number: 5,360,085

[45] Date of Patent: Nov. 1, 1994

[54] ELEVATOR CAB POSITION SENSING WITH REDUCED OPERATING NOISE

[75] Inventors: Young S. Yoo, Avon; Richard C. McCarthy, Simsbury, both of Conn.

[73] Assignee: Otis Elevator Company, Farmington, Conn.

[21] Appl. No.: 110,035

[22] Filed: Aug. 20, 1993

[51] Int. Cl.[5] ..... B66B 7/02

[52] U.S. Cl. ..... 187/406; 187/394

[58] Field of Search ..... 187/134, 136, 103, 139, 187/130, 104, 52 LC, 52 R, 28, 95

[56] References Cited

U.S. PATENT DOCUMENTS

| | | | |
|---|---|---|---|
| 2,498,299 | 2/1950 | Rissler | 187/95 |
| 3,425,516 | 2/1969 | Minejiro et al. | 187/95 |
| 3,554,327 | 1/1971 | Takamura et al. | 187/95 |
| 3,856,116 | 12/1974 | Savage | 187/134 |
| 5,135,081 | 8/1992 | Watt et al. | 187/134 |

*Primary Examiner*—Kenneth W. Noland

[57] ABSTRACT

The position of the elevator cab in an elevator system is detected by sensing the location of the cab relative to a flexible graduated tape whose ends are fixed in the elevator hoistway. The tape is provided with detectable components which are spaced a predetermined distance apart on the tape. Sensors are fixed on the elevator cab assembly adjacent to the tape so that the sensors can detect each of the tape components as the elevator cab moves up and down in the hoistway. Guides are mounted on the cab assembly to engage the tape so as to ensure that the tape and sensors are properly positioned relative to each other so that the tape components will be detected by the sensors. The guides are mounted on leaf or blade springs so as to be able to move relative to the cab assembly in response to tape deflections and correct the tape deflections to guide the tape past the sensors without creating a significant amount of noise.

2 Claims, 2 Drawing Sheets

ELEVATOR CAB POSITION SENSING WITH REDUCED OPERATING NOISE

TECHNICAL FIELD

This invention relates to an assembly for monitoring the vertical location of an elevator cab in a hoistway in a manner which does not create significant noise in the elevator cab.

BACKGROUND ART

In order for elevator cabs to properly align with landing door sills prior to opening the cab and landing doors to discharge and/or take on passengers, the vertical position or location of the cab in the elevator hoistway must be very accurately established. There are two general types of cab position information that must be provided to the elevator microprocessor controller in order to properly operate the elevator in a safe manner. These are: gross cab position when the cab is outside of a called landing zone; and fine cab position once the cab has entered a called landing zone. It will be understood that a "called landing zone" is one to which the elevator controller has, for some reason, dispatched the cab, and at which the cab and landing doors will be opened to accept or discharge passengers.

In order for an elevator system to operate at maximum efficiency, especially in high rise, and ultra high rise, high speed elevator systems, it is very important that the elevator cab move at high speeds between called landings during an optimum proportion of the landing-to-landing transit time. The requirement of high landing-to-landing transit speed also depends on effective cab acceleration and deceleration distances in order to maintain passenger comfort. Thus, the elevator controller must know at all times the position of cab between called landing zones. Present systems utilize a position transducer in the machine room to monitor drive shaft or traction sheave rotation in order to derive the gross position of the cab between called landing zones.

Once the cab enters a called landing zone, the fine cab position is sensed by monitoring a calibrated tape which is suspended in the elevator hoistway. The tape is used to determine when the cab door sill and landing door sill are properly aligned so that the doors can be opened to discharge and accept passengers. The tape is a metal tape which has its ends fixed to the top and bottom of the hoistway. There are spaced-apart detectable calibrations on the tape which indicate where in the hoistway the cab is located. These calibrations will determine cab positions within one-quarter of an inch relative to the hoistway walls. The calibrations can take the form of spaced magnetic strips on the tape. As previously noted, the tape is secured to the hoistway at its ends, and thus its medial portion is not fixed relative to any vertical plane in the hoistway. The portion of the tape between its ends is thus free to twist in response to hoistway turbulence, building sway, or the like. In addition, the cab will oscillate forwardly and backwardly to some extent as it moves up and down in the hoistway along its guide rails.

The tape is sensed by electrical sensors which are mounted on the elevator cab assembly, typically on the cab assembly frame. These sensors can be electro-magnetic or optical transducers. The sensors are operably connected to the elevator controller so as to transmit cab position signals to the controller at appropriate times. At the present time the sensors and their operating electronic components are disposed in a housing which includes guides that embrace the tape so as to ensure proper alignment of the sensors and the tape calibrations as the elevator cab moves up and down in the hoistway. The guides are fixed to the sensor housings. The sensor housings are mounted on brackets which are fixed to the cab frame.

In order to accommodate extant deflections of the tape which deviate from the relatively fixed vertical path of travel of the elevator cab, the sensor housings and associated tape guides are movably mounted on the cab frame mounting brackets. The sensor housings can thus move translationally on the mounting brackets whenever the guides encounter tape deflections that induce such translatory or oscillating movement. The present mounting system has proven to be operative, and is able to properly position the sensors and tape calibrations so as to provide accurate position signals to the controller; however, it does create a noise problem due to the oscillations of the sensor housings on the fixed cab mounting brackets. This noise problem is particularly bothersome during the high speed motion of the cab between landing zones, since the sensor guides must necessarily engage the tape even when the sensors are not functioning due to the cab being positioned outside of the landing zone. Passenger comfort would be enhanced if this tape guide-generated noise were eliminated or sharply reduced.

DISCLOSURE OF THE INVENTION

This invention relates to an elevator position tape sensor and guidance assembly which generates little if any operating noise than can be detected by passengers in the elevator cab. The sensors are fixed to brackets which are in turn secured to the elevator cab frame. The tape guides are connected to the sensors by means of flexible blade springs so that the guides can oscillate to either side of the sensors when tape deflections are encountered. The guides thus maintain constant contact with the tape throughout the entire run of the elevator cab in the hoistway, but the movement of the guides needed to accommodate tape deflections is essentially noiseless.

It is therefore an object of this invention to provide an improved elevator cab position sensor-tape assembly which operates in a substantially noise-free manner.

It is an additional object of this invention to provide a position sensor assembly of the character described which can accommodate tape deflections and maintain full contact with the position-indicating tape without generating passenger-disturbing noise in the cab.

It is a further object of this invention to provide a position sensor of the character described which can be readily retrofitted onto existing equipment in the field.

It is another object of this invention to provide a position sensor of the character described which can lessen noise generated by the sliding contact between the tape and the tape-engaging guides on the sensors.

These and other objects and advantages of the invention will become more readily apparent from the following detailed description of a preferred embodiment of the invention when taken in conjunction with the accompanying drawings in which:

BEST MODE FOR CARRYING OUT THE INVENTION

Figure 1:
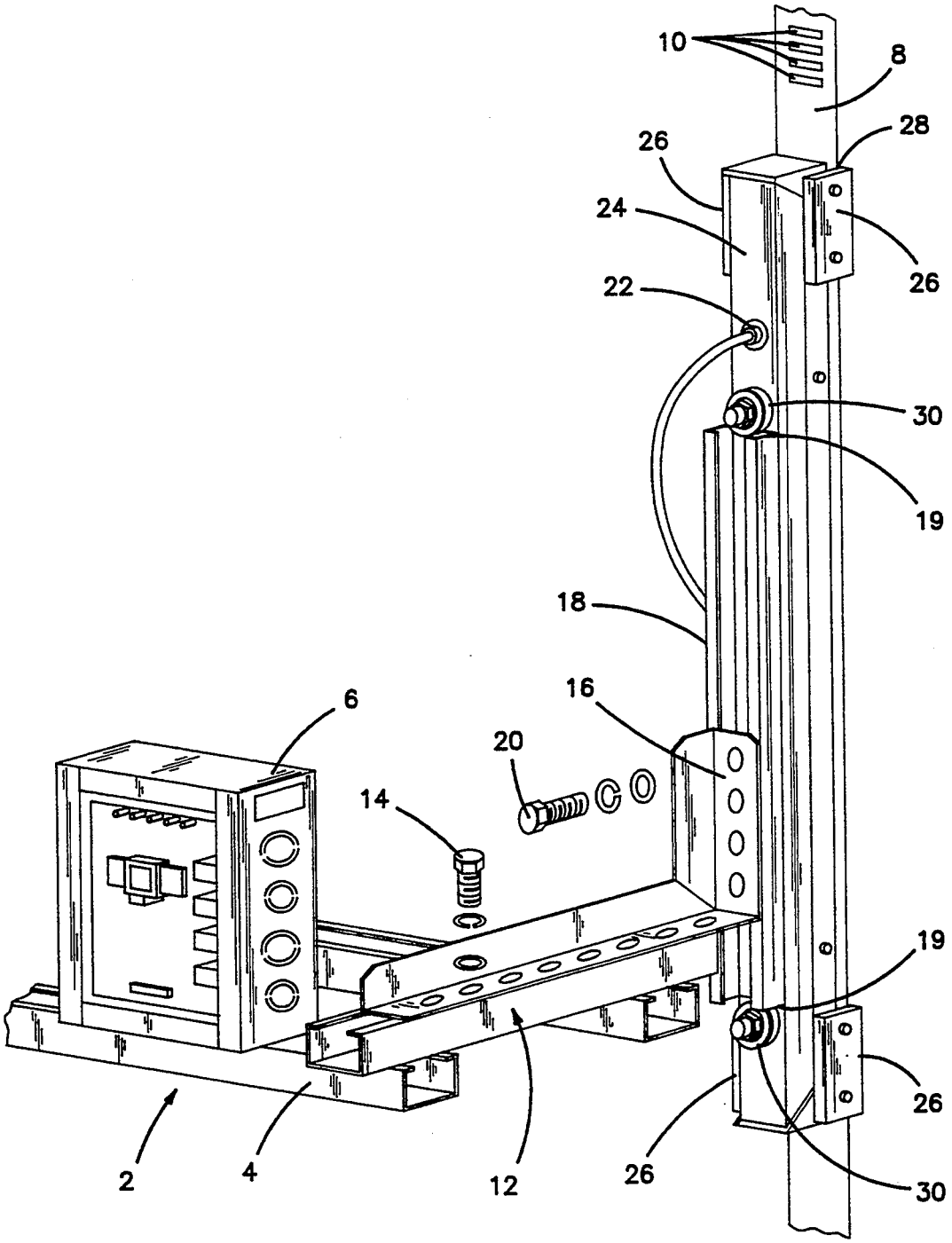
FIG—1 (PRIOR ART)
FIG. 1 is a fragmented perspective view of an elevator cab position sensor and tape which is formed in accordance with the teachings of the prior art.

Referring now to FIG. 1, there is shown an elevator cab position sensor assembly which is formed in accordance with the teachings of the prior art. The cab assembly is denoted generally by the numeral 2. The cab door controller 6 is mounted on the cab frame 4 and functions to control operation of the cab and landing doors when the cab assembly 2 is properly positioned in the hoistway at the landing. The position-indicating tape 8 is mounted in the hoistway to one side of the cab assembly 2. It will be understood that the tape 8 has its upper and lower ends fixed in place relative to the hoistway ceiling and floor, respectively, so that the tape 8 can provide an indication of the location of the cab assembly 2 in the hoistway. In order to perform this location-indicating function, the tape 8 is provided with sensible calibration components 10 which may take the form of detectable magnets mounted on the tape 8. The components 10 will be spaced apart along the tape 8 in predetermined increments so as to provide an indication of where the cab assembly 2 is along the length of the tape.

An L-shaped bracket 12 is attached to the cab frame 4 by means of bolts 14. The bracket 12 has a vertical arm 16 which extends upwardly from the cab frame 4 and parallel to the tape 8. An elongated channel bracket 18 is fixed to the vertical arm 16 by bolts 20. Proximity sensors 22 are mounted on an elongated housing 24 to which are fixed a plurality of guide shoes 26. The guide shoes 26 have vertical slots 28 through which the edges of the tape 8 are threaded. The guide shoes 26 thus ensure that the magnetic strips 10 are properly aligned and close to the proximity sensors 22 as the cab assembly 2 moves up and down through the hoistway. The guide shoes 26 are preferably made from ultra high molecular weight polyethylene, or a similar durable, low coefficient of friction plastic. The housing 24 is movably supported on the channel bracket 18 by a pair of grooved rollers 30 which are rotatably mounted on the housing 24 and which ride on the ends 19 of the channel bracket 18. The guides 26 are thus able to maintain contact with the tape 8 despite localized twists in the plane of the tape 8 which occur in the system. When such twists are encountered, the housing 24 simply rocks back and forth on the bracket 18. Tape and guide contact is thus maintained; however, the movement of the rollers 30 on the bracket 18 creates noise which can be heard by passengers in the cab.

Figure 2:
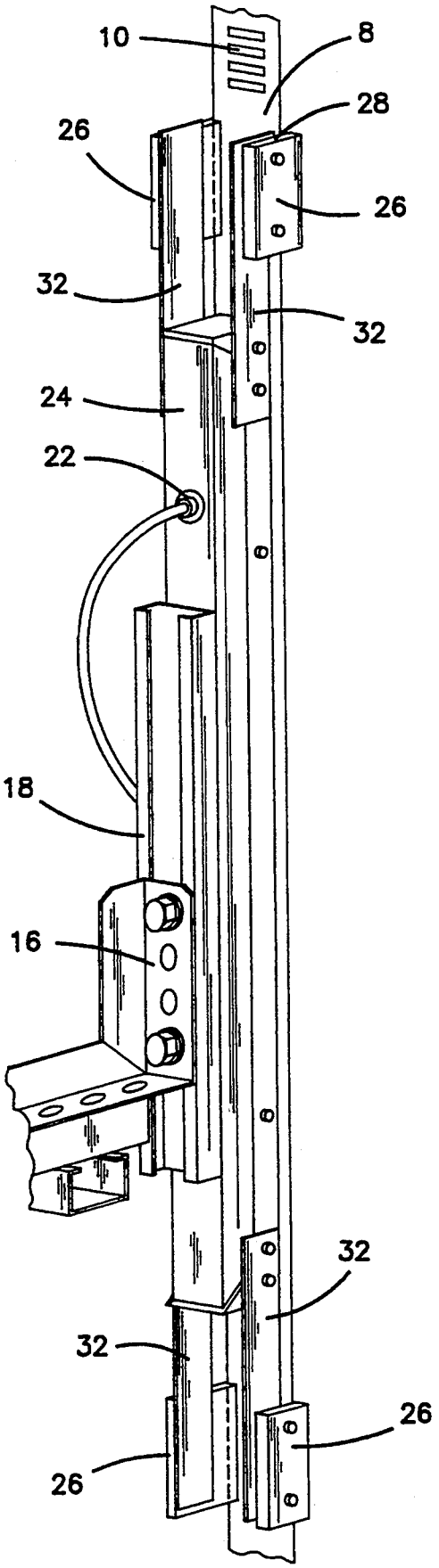
FIG. 2 is a similar view of a cab sensor assembly formed in accordance with this invention.

Referring now to FIG. 2, the improvement in the mounting system which reduces or eliminates the-cab noise is shown. As before, the bracket 18 is fixed to the arm 16. The housing 24 is fixed to the bracket 18 and immobilized with respect to the bracket 18. A pair of spring steel blades 32 are secured to the sides of the housing 24 at each end thereof, the blades 32 extending upwardly and downwardly away from the housing 24 adjacent to the tape 8. The guide shoes 26 are mounted on the distal ends of the blade springs 32 and are positioned thereon so as to engage the opposite edges of the tape 8. When tape twists or deviations in alignment are encountered by the guides 26, the blade springs 32 simply flex on the fixed housing 24 so that the contact between the edges of the tape 8 and the guide slots 28 is maintained at all times. The blade spring flexure produces substantially less noise that can be detected in the cab by passengers. The result is a quieter ride even at high speeds in high rise and ultra high rise buildings. The blade springs 32 are preferably formed from 0.025" thick spring steel, and are about one inch wide and 3–5" long. Very flexible through plane characteristics, along with very stiff cross plane characteristics are obtained. The blade springs 32 thus will impose minimal deflecting forces to the tape 8 as the cab moves forwardly and backwardly as it moves up and down in the hoistway. At the same time the stiffness of the springs 32 in the direction normal to the plane of the tape 8 will ensure that the magnetic strips 10 will be appropriately spaced from the sensors 22 during operation of the elevator.

It will be readily appreciated that the position sensor/tape guide assembly of this invention is structurally simple, and operates in a relatively noiseless manner. Equipment in the field can be easily reworked to incorporate the subject sensor and tape guide assembly. The blade spring guide mounts provide high front to back flexibility to accommodate tape twists or deflections, along with cab motion oscillations. At the same time, the guide mounts ensure that the tape will be properly positioned relative to the proximity sensors due to the transverse stiffness of the blade springs.

Since many changes and variations of the disclosed embodiment of the invention may be made without departing from the inventive concept, it is not intended to limit the invention otherwise than as required by the appended claims.

What is claimed is:

1. An elevator cab position sensing assembly comprising:

a) a tape suspended in an elevator hoistway, said tape including electronically detectable components thereon located in the vicinity of landing zones in the hoistway;

b) proximity sensing means secured to the elevator cab and positioned closely adjacent to said tape, said proximity sensing means being stationary relative to the elevator cab;

c) guide means engaging opposite side edges of said tape for controlling the relative positioning of said proximity sensing means and said tape; and d) flexible mounting means connecting said guide means to said proximity sensing means, said flexible mounting means providing flexible movement of said guide means along said tape in a direction parallel to the plane of the tape while concurrently restricting movement of said guide means and said tape in a direction perpendicular to the plane of the tape whereby said electronically detectable components will be positioned in close proximity to said proximity sensing means as the elevator cab travels through the hoistway.

2. The position sensing assembly of claim 1 wherein said flexible mounting means are blade springs mounted on opposite sides of said proximity sensing means and extending upwardly and downwardly away from upper and lower ends of said proximity sensing means.

* * * * *